United States Patent [19]

Young et al.

[11] Patent Number: 4,930,587

[45] Date of Patent: Jun. 5, 1990

[54] CORING TOOL

[75] Inventors: David E. Young, Seabrook; Earl T. Koskie, Jr., Conroe; Andrew R. Easton, Oak Ridge North, all of Tex.

[73] Assignee: Diamant Boart-Stratabit (USA) Inc., Houston, Tex.

[21] Appl. No.: 400,132

[22] Filed: Aug. 28, 1989

Related U.S. Application Data

[63] Continuation-in-part of Ser. No. 342,792, Apr. 25, 1989, abandoned.

[51] Int. Cl.[5] ..... E21B 10/02; E21B 25/14

[52] U.S. Cl. ..... 175/251; 175/253; 175/254

[58] Field of Search ..... 175/58, 249, 251, 253, 175/254

[56] References Cited

U.S. PATENT DOCUMENTS

| | | | |
|---|---|---|---|
| 3,225,845 | 12/1965 | Koontz et al. | 175/236 |
| 3,292,717 | 12/1966 | Hall et al. | 175/46 |
| 3,768,580 | 10/1973 | Mann et al. | 175/251 |
| 4,018,284 | 4/1977 | Perkins | 166/278 |
| 4,466,497 | 8/1984 | Soinski et al. | 175/246 |
| 4,606,416 | 8/1986 | Knighton et al. | 175/58 |
| 4,607,710 | 8/1986 | Radford | 175/249 |
| 4,664,205 | 5/1987 | Knighton et al. | 175/58 |

FOREIGN PATENT DOCUMENTS

| | | | |
|---|---|---|---|
| 0173299 | 3/1986 | European Pat. Off. | 175/251 |

*Primary Examiner*—William P. Neuder

*Attorney, Agent, or Firm*—Burns, Doane, Swecker & Mathis

[57] ABSTRACT

A coring tool comprises a core cutting section and an actuating section disposed thereabove. The core cutting section includes axially telescoping outer and inner barrels. The inner barrel includes a jaw carrier which carries pivotable core-catching jaws normally covered along their radially inner sides by a driver sleeve. When the driver sleeve is raised by the actuator section the jaws are uncovered. Thereafter, the driver sleeve raises the jaw carrier to bring the jaws into contact with a stationary inclined jaw-deflecting surface to force the jaws laterally inwardly through the core. The actuator section relies upon fluid pressure to release for movement a vertically risible member which is mechanically lifted by a drill string to transmit vertical forces to the driver sleeve from a drill string.

11 Claims, 6 Drawing Sheets

10
103
12
110
134
136
140
104
144
112
143
128
122
130
128
106
145
104
119
117
12
116
100
102
104

CORING TOOL

RELATED INVENTION

This a Continuation-In-Part of U.S. Application Ser. No. 07/342,792 filed on Apr. 25 1989, which is hereby abandoned in favor of the present application.

BACKGROUND OF THE INVENTION

The present invention relates to well drilling operations and, in particular, to an apparatus for cutting and removing a core of a subterranean formation to be tested.

During the drilling of oil and gas wells it is desirable to periodically remove samples of the subterranean formation for analysis. The samples are obtained by means of a coring tool which is inserted into the well bore after the main drill bit has been raised from the bore. The coring tool includes a hollow bit which cuts a cylindrical core from the formation.

After the coring tool has cut the core, it is necessary for the core to be separated from the subterranean formation and raised to the surface. Traditionally, the coring tool has contained a mechanism which grips and, in effect, secures the core to the tool. One such mechanism, disclosed for example in Knighton et al U.S. Pat. No. 4,606,416, contains a movable cam ring that is spring-biased downwardly by means of a compressed coil spring into engagement with pivotable gripping jaws. Subsequent to the core-cutting step, a jaw covering sleeve is raised to uncover the jaws, whereupon the spring actuated cam ring drives the jaws laterally into the core to penetrate and grip same.

Because available space within a coring tool is limited, the need to house a spring large enough to exert a sufficiently high force upon the jaws presents certain design problems. In that regard, it will be appreciated that the force exerted by a coil spring is a function of the length of its compression; thus, as the coil spring expands while driving the cam ring, the force which it exerts becomes progressively diminished. Hence, the size and strength of the spring must be such as to compensate for such behavior.

Furthermore, after the coring tool has been raised to the surface and stripped of its core it is necessary that the spring be recocked before the tool can be re-lowered to cut another sample core. That procedure adds to the time and difficulty involved in carrying out core sampling operations, involving the taking of multiple samples

SUMMARY OF THE INVENTION

The present invention relates to a coring tool adapted to be mounted at a lower end of a drill string for cutting and catching a subterranean core. The coring tool comprises outer and inner barrels. The outer barrel includes a hollow drill bit disposed at a lower end of the barrel and adapted to be rotated about a vertical longitudinal axis for cutting a core. The inner barrel is disposed coaxially within the outer barrel and includes a jaw carrier, a driver sleeve disposed coaxially within the jaw carrier, and a jaw closing member disposed laterally between the jaw carrier and the driver sleeve. The jaw carrier is mounted for longitudinal displacement relative to the outer barrel and includes a downwardly facing stop surface and a jaw arranged to be laterally inwardly displaced from a rest position to a core catching position. The jaw closing member is disposed above and in a longitudinal path of the jaw. The jaw carrier is arranged to be upwardly displaceable relative to the jaw closing member. The driver sleeve extends downwardly past the jaw to radially cover the jaw during a core cutting operation and includes an upwardly facing abutment face. The driver sleeve is arranged to be upwardly displaced relative to both the jaw carrier and the jaw closing member in response to the application of upward force to the driver sleeve by a drill string to radially uncover the jaw and bring the abutment face into engagement with the stop surface to displace the jaw carrier upwardly such that the jaw is raised into contact with the jaw closing member and is subjected to a deflecting force therefrom which deflects the jaw from the rest position to the core catching position. The jaw closing member is operably connected to the outer barrel such that the weight of the outer barrel is applied downwardly against the jaw through the jaw closing member.

The present invention also contemplates an actuating section disposed above the outer barrel and connected thereto such that a portion of the weight of the actuating section is applied against the jaw. The actuating section is disposed above the core catching section and includes an outer sleeve assembly operably connected to the outer barrel and an inner sleeve assembly disposed coaxially within the outer sleeve assembly and operably connected to the inner barrel for transmitting vertical forces thereto. The inner sleeve assembly defines a longitudinal fluid passage and comprises a plurality of radial dogs extending radially between the inner and outer sleeve assemblies. The dogs are radially movable between a radially outward locking position preventing upward movement of the inner sleeve assembly relative to the outer sleeve assembly, and a radially inward unlocking position permitting said inner sleeve assembly to move upwardly relative to the outer sleeve assembly. A dog release member is disposed within the fluid passage and includes a surface arranged for locking movement of the dogs from the locking position to the unlocking position. The dog release member includes a plurality of flexible fingers latched to a shoulder of the inner sleeve assembly to prevent downward movement of the dog release member. The dog release member includes a longitudinal fluid port having an upwardly facing seat adapted to receive a plug dropped from the ground surface for blocking the port until fluid pressure moves the dog release member downwardly to unblock the dogs and permit the dogs to be cammed radially inwardly in response to vertical movement of the inner sleeve assembly relative to the outer sleeve assembly.

BRIEF DESCRIPTION OF THE DRAWINGS

The objects and advantages of the invention will become apparent from the following detailed description of preferred embodiment thereof in connection with the accompanying drawings, in which like numerals designate like elements, and in which.

DETAILED DESCRIPTION OF A PREFERRED EMBODIMENT OF THE INVENTION

Figure 1:
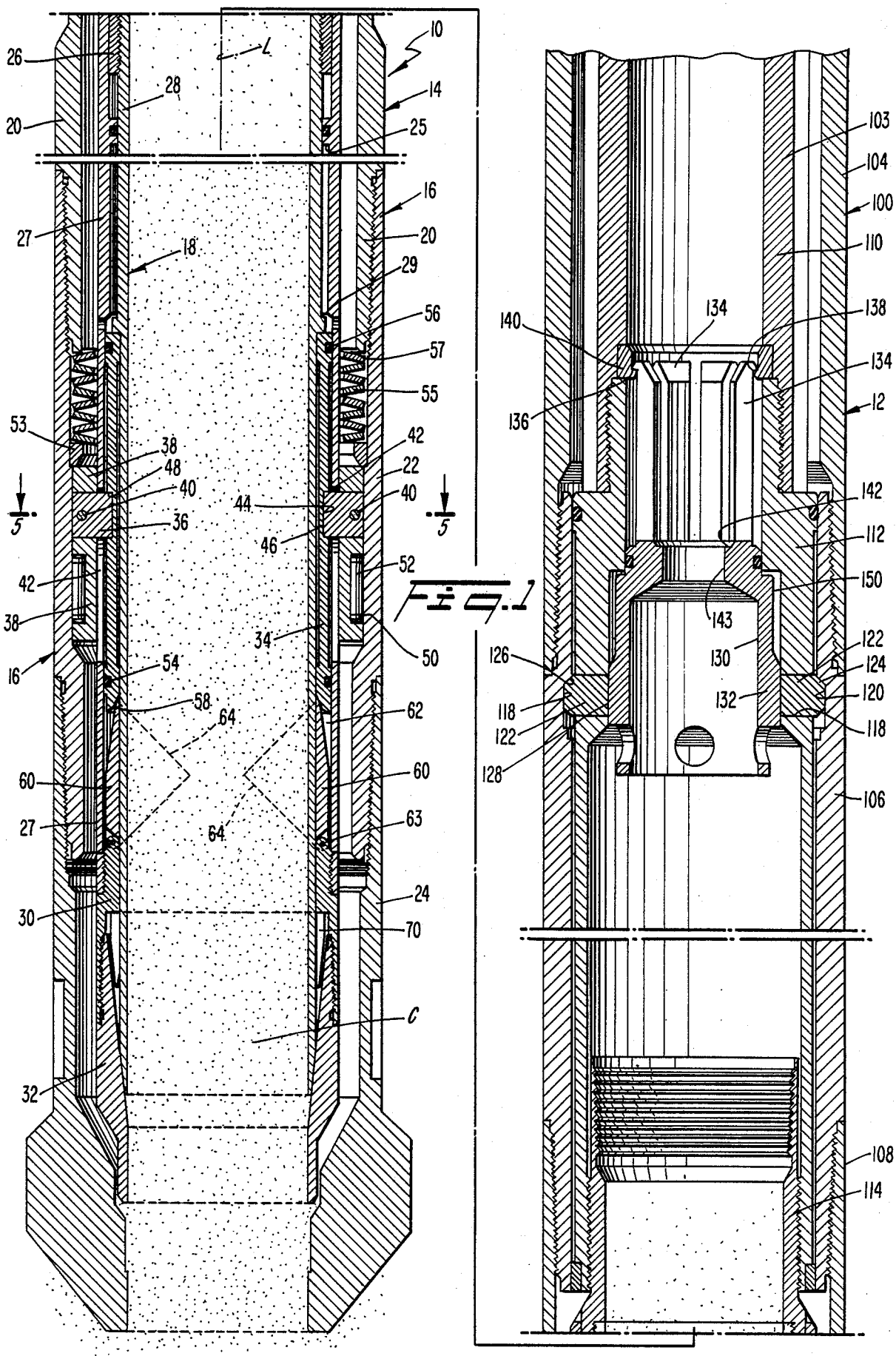
FIG. 1 is a longitudinal sectional view through a coring tool according to the present invention after a core has been cut and before the core catching jaws have been displaced laterally inwardly.

A core cutting tool 10 according to the present invention comprises an actuator section 12 (depicted on the right side of FIG. 1) adapted to be suspended from a drill string (not shown), and a catcher section 14 (depicted on the left side of FIG. 1). The actuator section 12 is operable to actuate a core catching mechanism within the catcher section after a core sample has been cut from a subterranean formation.

The Catcher Section

The catcher section 14 comprises an outer barrel section 16 and an inner barrel section 18 telescopingly disposed therein. The outer barrel section 16 comprises an outer adapter sub 20, a bit sub 22 threadedly coupled to a front or lower end of the outer adapter sub 20, and a drill bit 24 threadedly coupled to a lower end of the bit sub 22. The drill bit carries cutting elements enabling a core to be cut as the drill bit is rotated about a longitudinal axis L.

The inner barrel section 18 comprises an inner adapter sub 26, a drive sleeve 28 threadedly coupled to a lower end of the inner adapter sub 26, a cylindrical closure housing 27 coaxially arranged around the inner adapter sub 26 and the driver sleeve 28, a closure sub 30 threadedly coupled to a lower end of the closure housing, and a catcher sub 32 threadedly coupled to a lower end of the closure sub 30. The closure housing 27 includes a radially inwardly projecting stop surface 25 which faces axially downwardly toward an upwardly facing abutment face 29 projecting radially outwardly from the driver sleeve 28.

Disposed radially between the driver sleeve 28 and the closure housing 27 is a closure sleeve 34. The closure sleeve 34 is fixed against longitudinal displacement by means of a plurality of radial keys 36 which extend radially inwardly from a bearing ring 38 mounted on the outer circumference of the closure housing 27. The keys 36 are mounted to the bearing ring 38 by means of pins 40 and project through longitudinally extending slots 42 in the closure housing 27. Radially inner ends of the keys are received in an annular groove 44 formed in the outer circumference of the closure sleeve 34. The keys engage upper and lower radial shoulders 46, 48 of the groove to longitudinally or vertically constrain the closure sleeve.

An outer circumference of the bearing ring 38 includes an annular groove 50 which carries bearings 52. The bearings 52 engage an inner circumference of the bit sub 22 to promote rotation of the outer barrel section 16 relative to the inner barrel section 18 about the longitudinal axis L of the tool. An upper end of the bearing ring 38 engages the underside of a contact ring 53 which is biased downwardly by a resilient shock-absorbing spring 55 comprised for example of a stack of Belleville washers or the like which are configured to permit a fluid flow therepast. The spring 55 is sandwiched between the contact ring 53 and a radial shoulder 57 of the outer adapter sub 20. As will be appreciated, upward forces applied to the closure sleeve 34 (in a manner to be discussed) will be transmitted to the outer barrel section 16 through the keys 36, the bearing ring 38, the contact ring 53, and the spring 55. The spring 55 is not absolutely required, but due to its presence, the relative locations of the various movable components do not have to be made with precise tolerance. The movement afforded by the spring compensates for imprecise tolerance, as well as wearing of parts.

The stationary closure sleeve 34 carries a pair of O-ring seals 54, 56 at opposite longitudinal ends thereof, which seals engage an inner circumference of the closure housing 27 in fluid-tight manner. A front end surface 58 of the closure sleeve 34 is of generally frustoconical configuration, for reasons to be explained hereinafter.

Pivotably mounted to a rear end of the closure sub 30 is a pair of closure jaws 60. The closure jaws 60 are of conventional configuration, and are arranged to be seated within an annular space 62 defined between the inner circumference of the closure housing 27 and the outer circumference of the driver sleeve 28. The jaws are in the general shape of cylindrical segments and are pivoted at their lower ends by means of pivot pins 63 which extend generally tangentially relative to the radius of the closure sub 30. The jaws are shaped such that when they are pivoted inwardly by 45°, their circumferential upper edges 64 contact one another along an interference lying in a longitudinal plane (see FIG. 3). To accomplish this, the upper edges 64 are raked downwardly from the uppermost ends of the jaws in the customary manner.

Actuator Section

Figure 4:
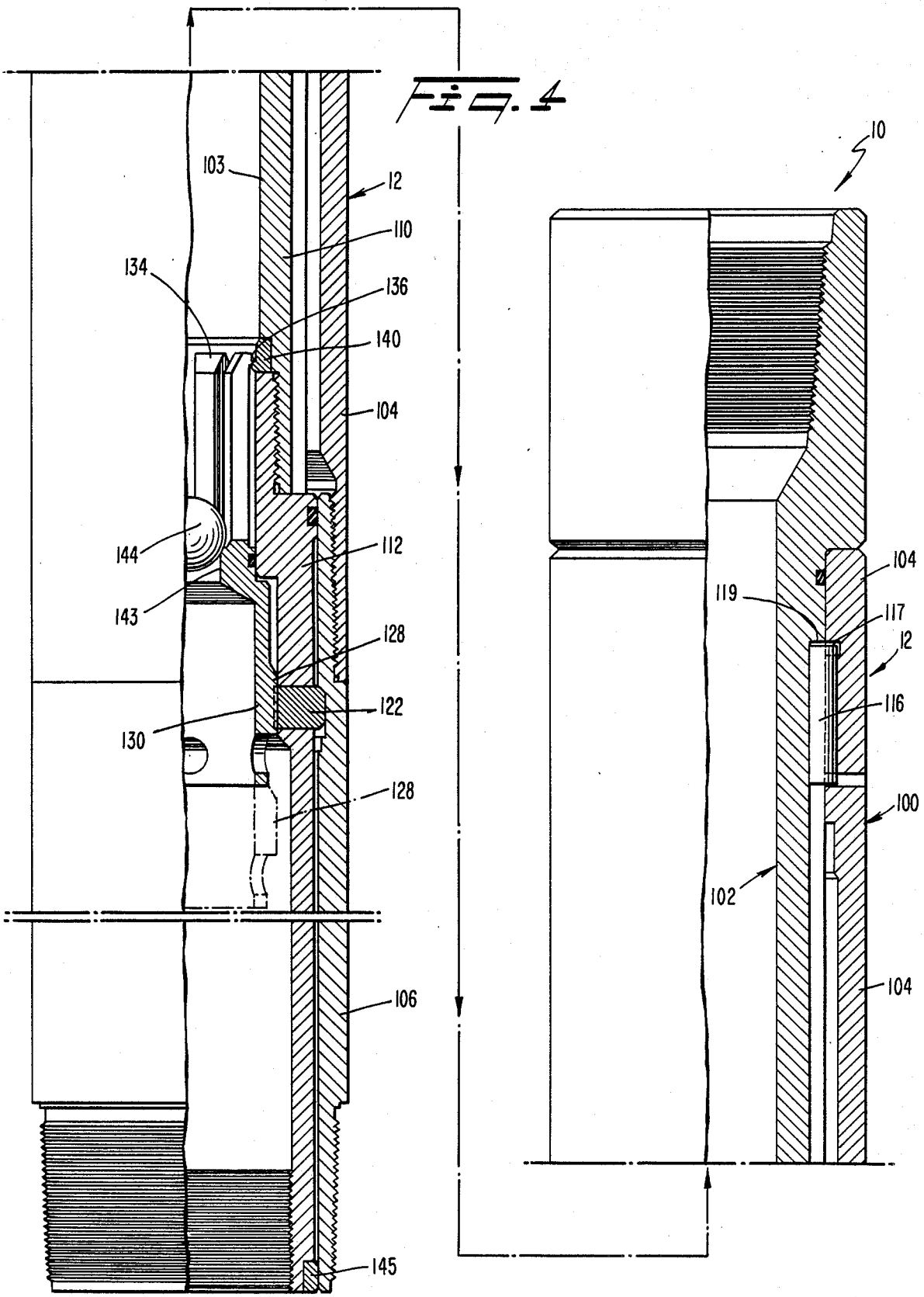
FIG. 4 is a longitudinal sectional view taken through an upper, actuating section of the coring tool after a ball has been dropped onto a dog release member of the actuating section.
Figure 5:
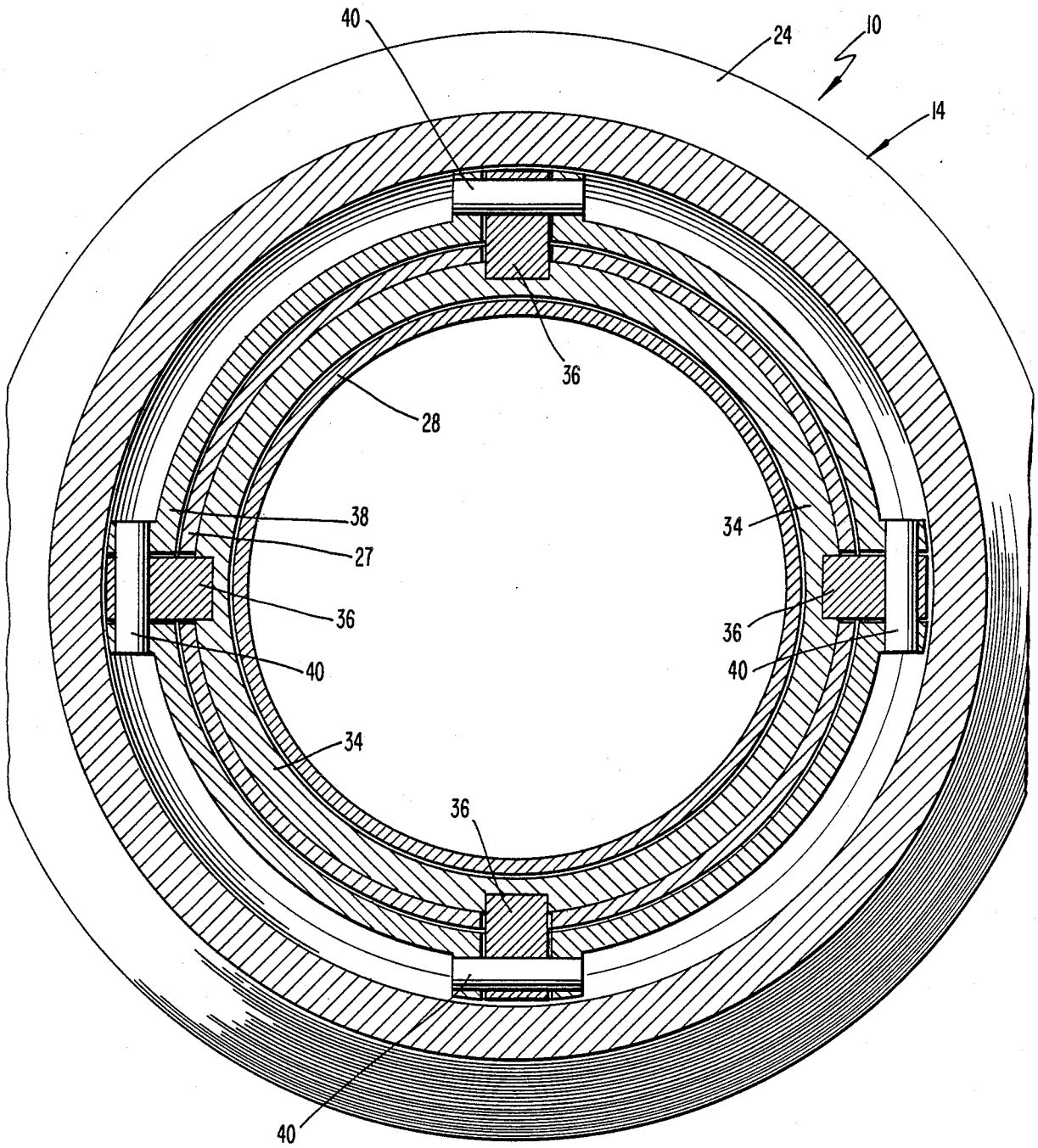
FIG. 5 is a cross-sectional view taken along the line 5—5 in FIG. 1.
Figure 6:
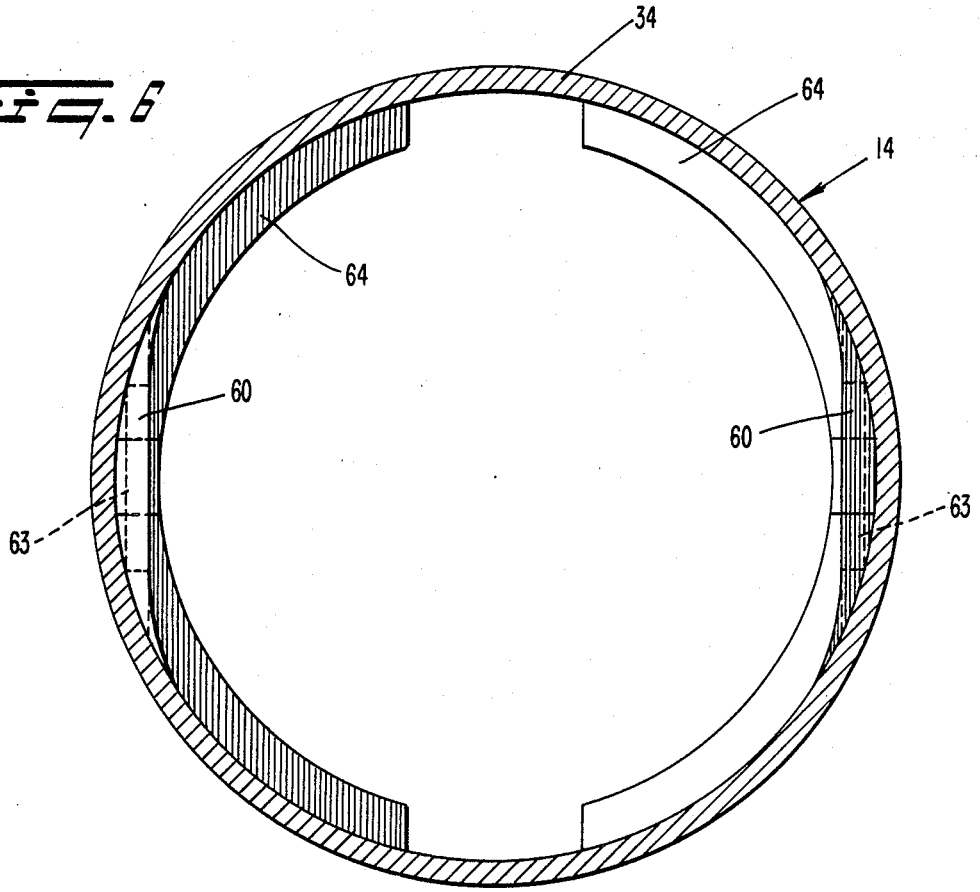
FIG. 6 is a cross-sectional view taken along the line 6—6 in FIG. 2
Figure 7:
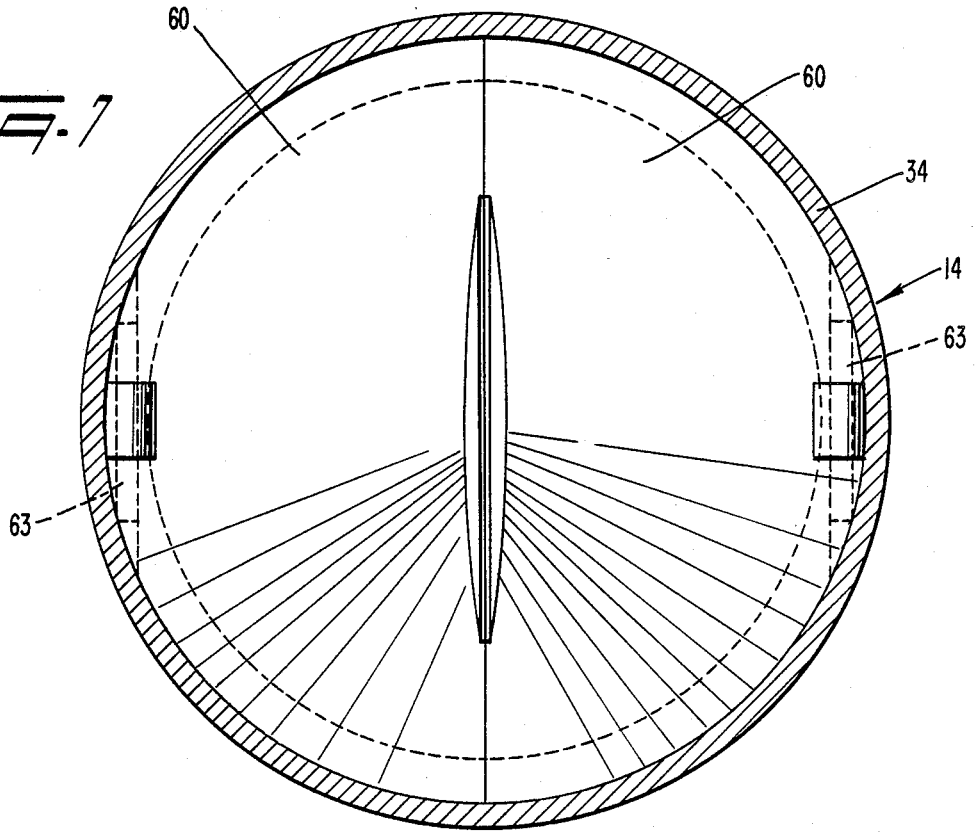
FIG. 7 is a cross-sectional view taken along the line 7—7 in FIG. 3.

The actuator section 12 comprises an outer sleeve assembly 100 and an inner sleeve assembly 102 telescopingly disposed within the outer sleeve assembly (see FIGS. 1 and 4). The outer sleeve assembly 100 comprises a cylindrical spline housing 104, a lower adapter sub 106 threadedly connected to a lower end of the spline housing 104. An upper portion 108 of the outer core barrel is threadedly coupled to a lower end of the adapter sub 106. A lower end of the portion 108 is threadedly connected to an upper end of the outer adapter 20 of the catcher section 14, such connection not being depicted. There may exist one or more outer barrel extensions (not shown) connected between the portion 108 and the adapter 20.

The inner sleeve assembly 102, which defines a longitudinal fluid passage 103, comprises an upper sub 110, a release sub 112 threadedly coupled to a lower end of the upper sub 110, and an inner connector tube 114 threadedly coupled to a lower end of the release sub 112. The inner connector tube 114 includes relatively rotatable sections (not shown), a lower one of which is threadedly coupled to an upper end of the inner adapter sub 26 of the catcher section 12. In the event that additional outer barrel extensions are added, as discussed above, then additional inner barrel sections of a length equal to that of the added outer barrel sections are connected between the inner connector tube 114 and the upper end of the inner adapter sub 26. As a result, rotation of the inner sleeve assembly 102 is not transmitted to the inner barrel 18 of the catcher section 14.

Longitudinal splines 116 (FIG. 4) sit in radially aligned slots 117, 119 formed in the inner circumference of the spline housing 104 and outer circumference of the rear sub 110, respectively, for transmitting rotary motion from the inner sleeve assembly 102 to the outer sleeve assembly 100. In that manner, rotary drive can be transmitted from the drill string (not shown) to the outer barrel section 16 of the catcher section 14 for rotating the drill bit 24.

The release sub 112 includes a plurality of radial slots 118 which are radially aligned with an annular groove 120 formed in the inner circumference of the lower adapter sub 106. A plurality of dogs 122 are loosely received in respective ones of the slots 118 and include radially outer ends disposed in the groove 120. An upper portion of each such dog outer end contains a bevel 124 which opposes a downwardly facing bevel 126 of the groove 120. The dogs are constrained against radial inward movement by a lower portion 128 of the outer circumference of a dog release member 130 disposed within the release sub 112. That outer circumference is disposed on a cylindrical portion 132 of the dog release member located radially opposite the dogs. Cantilevered longitudinally upwardly from an upper end of that cylindrical portion 132 are a number of circumferentially spaced locking fingers 134. Upper free ends of the fingers 134 comprise lateral hooks 136 which abut a frusto-conical retaining shoulder 138 formed on a release ring 140 sandwiched between adjacent ends of the rear sub 110 and release sub 112. The hooks 136 and the retaining shoulder 138 are acutely angled relative to the longitudinal axis such that the frusto-conical retaining shoulder 138 tapers downwardly.

A port 143 extends longitudinally through the dog release member 130. An upper end of the port forms a seat adapted to receive a plug, such as a ball 144 (see FIG. 4). Such a ball can be dropped into the drill string from the ground surface so as to gravitate downwardly onto the seat 142. It will be appreciated that during a core cutting operation the ball 144 is not present. Rather, the ball 144 is used only thereafter during the actuation of the core catcher for gripping the cut core.

Figure 8:
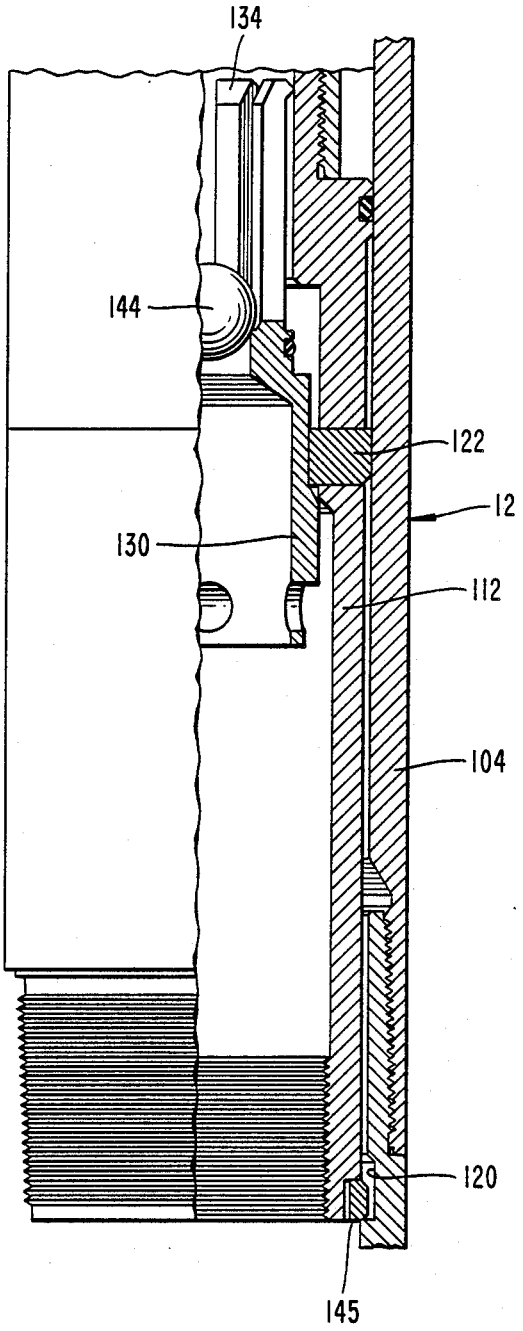
FIG. 8 is a view similar to FIG. 4 showing the condition when an inner sleeve assembly has moved upwardly relative to an outer sleeve assembly.

Carried at a lower end of the release sub 112 is a split ring 145 which although being biased radially outwardly is normally constrained against radial outward movement by the adapter sub 106. That ring 145 is adapted to be received in the groove 120 to thereafter prevent relative vertical movement between the inner and outer sleeve assemblies (see FIG. 8). The spacing between the ring 145 and the groove 120 corresponds to the upward distance traveled by the closure sub 30 during the jaw-actuating step to assure that the jaws are fully closed when the ring 145 snaps into the groove 120.

The outer circumference of the dog release includes a reduced diameter portion 150 disposed above the portion 128 of the outer circumference for a reason to be explained hereinafter.

In operation, the core catching tool 10 is lowered into a well bore by lowering a drill string (not shown) to which the rear sub 110 is attached. Upon reaching the bottom of the bore, the circulation of a drilling fluid down the inner diameter of the drill string commences, the drill string is rotated, and such rotation is transmitted through the splines 116 to the outer sleeve assembly 100 and from there to the drill bit 24. Rotation of the drill bit occurs relative to the inner barrel section 18. As the drill bit 24 is rotated and gradually advanced longitudinally downwardly, a core C is cut from the subterranean formation and progressively travels upwardly within a core cavity defined by the inner circumferences of the drive sleeve 28, the inner adapter sub 26, and the inner connector tube 114. The circulating drilling fluid removes the cuttings generated by the coring bit by conducting those cuttings upwardly within the annulus formed between the outer diameter of the coring tool and drill string on the one hand, and the inner diameter of the hole being generated by the drill bit on the other hand.

When the desired length of core has been cut, the rotation of the drill bit 24 is terminated, and the ball 144 is dropped into the drill string from the ground surface. The ball gravitates downwardly, or circulates downwardly within slowly circulating drilling fluid, and comes to rest upon the valve seat 142 (see FIG. 4), whereafter this drilling fluid is pressurized within the drill string and coring tool. The thus-pressurized fluid acts against the ball to urge the release ring downwardly with sufficient force to cause the hooks 136 of the locking fingers to flex radially inwardly out of engagement with the release ring 140.

The dog release is now advanced downwardly relative to the release sub 112 to shift the front portion of the outer circumference 128 of the dog release out of radial alignment with the dogs 122 as depicted in broken lines in FIG. 4. The dogs 122 are now free to be moved radially inwardly. Such radial inward movement of the dogs is induced by lifting upwardly on the drill string, whereupon the resulting upward forces on the release sub 112 and the beveled faces 124, 126 cause the dogs to be cammed radially inwardly out of the groove 120.

Figure 2:
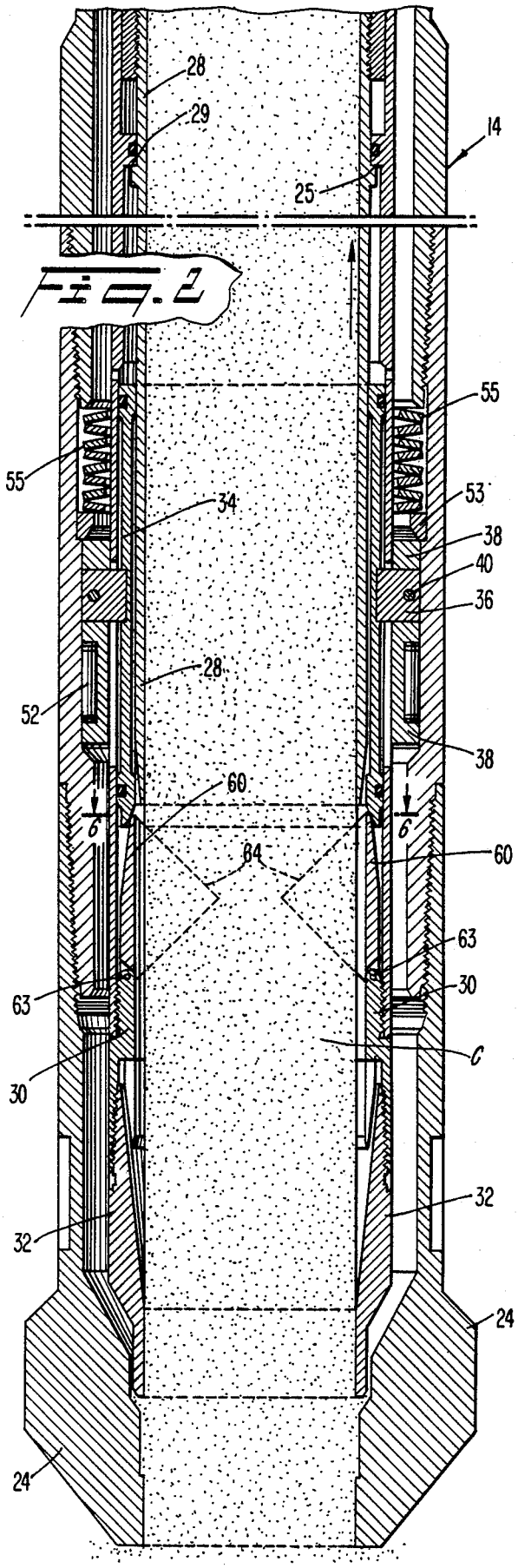
FIG. 2 is a longitudinal sectional view through a core catching portion of the coring tool after the jaws have been radially uncovered.
Figure 3:
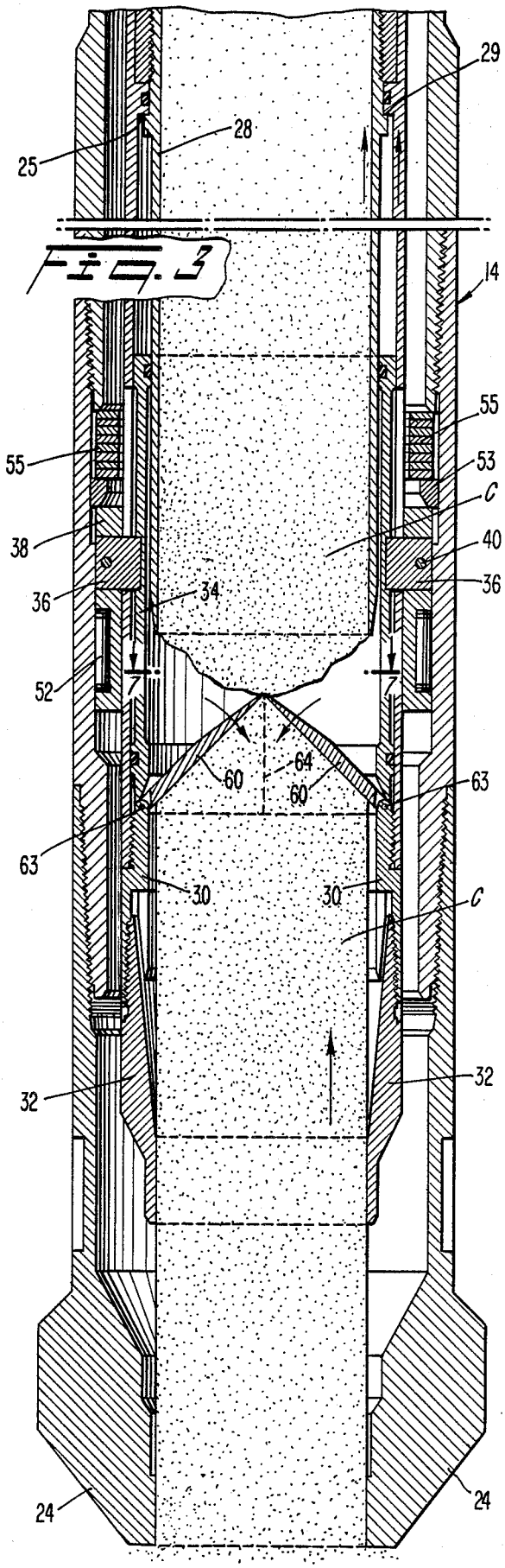
FIG. 3 is a view similar to FIG. 2 after the jaws have been displaced radially inwardly to capture the core.

The inner sleeve assembly 102 now travels upwardly relative to the outer sleeve assembly 100, thereby raising the driver sleeve 28 of the catcher section 14 relative to the core and relative to the closure housing 27 and the closure jaws 60. The longitudinal spacing between the abutment face 29 of the driver sleeve 28 and the stop surface 25 of the closure housing 27 is sufficient to permit the lower end of the driver sleeve 28 to be moved upwardly past the jaws 60. When the abutment face 29 thereafter engages the travel stop 25 as depicted in FIG. 2, continued lifting of the drill string causes the closure housing 27 and closure jaws 60 to be raised. Accordingly, the rear ends of the jaws 60 are forcefully deflected radially inwardly by the stationary surface 58 of the closure sleeve 34 as depicted in FIG. 3.

It will be appreciated that the force exerted by the core to resist penetration by the jaws is transmitted upwardly against the closure sleeve 34. The closure sleeve 34 moves upwardly, thus compressing the spring 55. When the spring 55 bottoms-out as depicted in FIG. 3, the total weight of the closure sleeve 34, bearing ring 38, outer barrel section 18 (including the drill bit 24 and any additional outer barrel extensions that may exist), the outer connecting tube 108 and the outer sleeve assembly 100 acts downwardly against the jaws. That downward force is of considerable magnitude and is applied continuously to the jaws, i.e., the force does not become progressively diminished as the jaws move inwardly, as would be the case if the jaws were actuated by a pre-stressed coil spring.

The coring tool is preferably utilized in soft formations whereby the jaws may fully penetrate through the core and contact one another. At that point, the ring 145 in the actuator section will radially overlie the groove 120 and will snap into that groove (see FIG. 8) to thereafter prevent any relative vertical movement between the inner and outer sleeve assemblies 100, 102 (and thus between the closure sub 30 and the closure sleeve 34). Accordingly, it is assured that the jaws cannot thereafter be inadvertently opened as the tool is being raised. Further lifting forces applied to the drill string will cause the core to break at a location below the jaws 60, enabling the tool 10 and core C to be brought to the surface.

It will be appreciated that in accordance with the present invention, a simplified core catching arrangement is provided which uniformly applies a strong closure force to the closure jaws without the need for a separate energy storing mechanism such as a prestressed spring. Rather, the closure force is produced by the weight of the tool components and is actuated by a relatively simple, but highly reliable actuating mechanism.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A coring tool adapted to be mounted at a lower end of a drill string for cutting and catching a subterranean core, comprising:

outer barrel means including a hollow drill bit disposed at a lower end of said barrel means and adapted to be rotated about a vertical longitudinal axis for cutting a core, and inner barrel means disposed coaxially within said outer barrel means and including jaw carrier means, driver sleeve means disposed coaxially within said jaw carrier means, and jaw closing means disposed laterally between said jaw carrier means and said driver sleeve means, said jaw carrier means mounted for longitudinal displacement relative to said outer barrel means and including a downwardly facing stop surface, and jaw means arranged to be laterally inwardly displaced from a rest position to a core catching position, said jaw closing means disposed above and in a longitudinal path of travel of said jaw means, said jaw carrier means arranged to be upwardly displaceable relative to said jaw closing means in response to upward movement of said jaw carrier means relative to said outer barrel, said driver sleeve extending radially inwardly of, and downwardly past, said jaw means to radially cover said jaw means during a core cutting operation and including an upwardly facing abutment face, said driver sleeve being arranged to be upwardly displaced relative to both said jaw carrier means and said jaw-closing means in response to the application of upward force to said driver sleeve by a drill string to radially uncover said jaw means and bring said abutment face into engagement with said stop surface to displace said jaw carrier means upwardly relatively to said outer barrel such that said jaw means is raised into contact with said jaw closing means and is subjected to a deflecting force therefrom which deflects said jaw means from said rest position to said core-catching position, said jaw-closing means being operably connected to said outer barrel means such that the weight of said outer barrel means is applied downwardly against said jaw means through said jaw-closing means.

2. A coring tool according to claim 1, wherein said jaw means comprises a plurality of closure jaws pivotably connected at their lower ends to said jaw carrier means.

3. A coring tool according to claim 1, wherein said jaw-closing means comprises a closure sleeve having an inclined lower surface against which said jaw means abuts.

4. A coring tool according to claim 1, including a bearing ring disposed coaxially with and radially between said jaw-carrier means and said outer barrel means at an elevation above said jaw means, said bearing ring being operably connected to said jaw-closing means by means of radial key passing through longitudinally elongated slots in said jaw-carrying means, said bearing ring carrying bearing means permitting said outer barrel means to rotate relative to said inner barrel means.

5. A coring tool according to claim 4, wherein said bearing ring is arranged to transmit upward forces from said jaw closing sleeve to said outer barrel means.

6. A coring tool according to claim 1, wherein said outer and inner barrel means define a core catching section of said tool, said tool including an actuating section disposed above said core-catching section, said outer barrel means being connected to said actuating section such that a portion of the weight of said actuating section is applied against said jaw means.

7. A coring tool according to claim 6, wherein said actuating section comprises an outer sleeve assembly and an inner sleeve assembly disposed coaxially within said outer sleeve assembly and defining a longitudinal fluid passage, said outer sleeve assembly being operably connected to said outer barrel means for transmitting rotary forces thereto, said inner sleeve assembly being operably connected to said driver sleeve for transmitting vertical forces thereto from the drill string, a plurality of radial dogs extending radially between said inner and outer sleeve assemblies and being radially movable between a radially outward locking position preventing upward movement of said inner sleeve assembly relative to said outer sleeve assembly and a radially inward unlocking position permitting said inner sleeve assembly to move upwardly relative to said outer sleeve assembly, said inner sleeve assembly including a dog release member disposed coaxially within said fluid passage, said dog release member including a surface blocking movement of said dogs from said locking position to said unlocking position, said dog release member including a plurality of flexible fingers latched to a shoulder of said inner sleeve assembly to prevent downward movement of said dog release member, said dog release member including a longitudinal fluid port having an upwardly facing seat adapted to receive a plug dropped from the ground surface for blocking said port until fluid pressure moves said dog release member downwardly to unblock said dogs.

8. A coring tool adapted to be mounted at a lower end of a drill string for cutting and catching a subterranean core, comprising:

outer barrel means including a hollow drill bit disposed at a lower end of said barrel means and adapted to be rotated about a vertical longitudinal axis for cutting a core, and inner barrel means disposed coaxially within said outer barrel means and including:

a jaw-carrier sleeve mounted for longitudinal displacement relative to said outer barrel means and including a downwardly facing stop surface, and a pair of pivotably mounted jaws arranged to be swung laterally inwardly from a rest position to a core catching position, a jaw closing sleeve having an upwardly and inwardly inclined lower surface arranged above and in a longitudinal path of travel of said jaws, said jaw carrier sleeve arranged to be upwardly displaceable relative to said jaw closing sleeve, a bearing ring disposed coaxially with and radially between said jaw-carrier sleeve and said outer barrel means at an elevation above said jaws, said bearing ring being operably connected to said jaw closing sleeve by means of radial keys passing through longitudinally elongate slots in said jaw-carrying sleeve, said bearing ring carrying bearing means permitting said outer barrel means to rotate relative to said inner barrel means, a driver sleeve disposed coaxially within said jaw carrying sleeve and extending downwardly past said jaws to radially cover said jaws during a core cutting operation and including an upwardly facing abutment face, said driver sleeve being arranged to be upwardly displaced relative to both said jaw carrying sleeve and said jaw-closing sleeve in response to the application of upward forces to said driver sleeve by a drill string to radially uncover said jaws and bring said abutment face into engagement with said stop surface to displace said jaw carrying sleeve upwardly such that said jaws are raised into contact with said inclined lower surface of said jaw closing sleeve and are subjected to a deflecting force therefrom which deflects said jaws from said rest position to said core-catching position, said jaw closing sleeve being operably connected to said outer barrel means through said bearing ring such that the weight of said outer barrel means is applied downwardly against said jaws through said jaw closing sleeve.

9. In a tool insertable into a well bore and including a lower section and an actuating section disposed above said lower section, said lower section including coaxially telescoping outer and inner portions, said inner portion being movable vertically relative to said outer portion, said actuating section disposed above said lower section and including an outer sleeve assembly operably connected to said outer portion, and an inner sleeve assembly disposed coaxially within said outer sleeve assembly and being operably connected to said inner portion for transmitting vertical forces thereto, said inner sleeve assembly defining a longitudinal fluid passage, and comprising:

a tubular portion containing a plurality of radial slots and shoulder surface means extending at an acute angle relative to a longitudinal axis of said tubular portion, a plurality of radial dogs disposed in said slots and extending radially between said inner and outer sleeve assemblies and being radially movable between a radially outward locking position preventing upward movement of said inner sleeve assembly relative to said outer sleeve assembly and a radially inward unlocking position permitting said inner sleeve assembly to move upwardly relative to said outer sleeve assembly, and a dog release member disposed within said fluid passage and including:

a surface arranged for blocking movement of said dogs from said locking position to said unlocking position, a plurality of flexible fingers each including a hook surface extending at an acute angle relative to said longitudinal axis and engaging said shoulder surface means to prevent downward movement of said dog release member, and a longitudinal fluid port having an upwardly facing seat adapted to receive a plug dropped from the ground surface for blocking said port until fluid pressure is sufficient to displace said hook surfaces from said shoulder surface means and move said dog release member downwardly to unblock said dogs and permit said dogs to be cammed radially inwardly in response to vertical movement of said inner sleeve assembly relative to said outer sleeve assembly.

10. A tool according to claim 9, wherein said tool comprises a coring tool, said outer portion comprising outer barrel means with a hollow drill bit for cutting a core, and said inner portion comprising inner barrel means carrying a core catcher for catching the core.

11. A tool according to claim 9, wherein said outer sleeve assembly includes a radially inwardly facing groove, said inner sleeve assembly carrying a snap ring which snaps into said groove after said dogs have been moved to their unlocking position and said inner sleeve assembly has moved upwardly relative to said outer sleeve assembly, whereby said snap ring locks said inner and outer sleeve assemblies together.

* * * * *